US012089703B2

(12) United States Patent
Moriyama et al.

(10) Patent No.: US 12,089,703 B2
(45) Date of Patent: Sep. 17, 2024

(54) JEWELRY ITEM AND METHOD FOR MANUFACTURING JEWELRY ITEM

(71) Applicant: JEWELRY MIURA CO., LTD., Tokyo (JP)

(72) Inventors: Hideki Moriyama, Tokyo (JP); Toshinori Miura, Tokyo (JP)

(73) Assignee: JEWELRY MIURA CO., LTD., Tokyo (JP)

( * ) Notice: Subject to any disclaimer, the term of this patent is extended or adjusted under 35 U.S.C. 154(b) by 80 days.

(21) Appl. No.: 17/520,282

(22) Filed: Nov. 5, 2021

(65) Prior Publication Data

US 2023/0000224 A1 Jan. 5, 2023

(30) Foreign Application Priority Data

Jun. 30, 2021 (JP) ..... 2021-109116

(51) Int. Cl.
*A44C 27/00* (2006.01)
*C22C 5/02* (2006.01)

(52) U.S. Cl.
CPC ..... *A44C 27/003* (2013.01); *A44C 27/007* (2013.01); *C22C 5/02* (2013.01)

(58) Field of Classification Search
CPC ..... A44C 27/003; A44C 27/005; A44C 27/00; C22C 5/02
See application file for complete search history.

(56) References Cited

U.S. PATENT DOCUMENTS 4,891,276 A * 1/1990 Exner ..... A44C 27/00 428/614
6,929,776 B1 8/2005 Loh
2012/0308844 A1* 12/2012 Derrig ..... A44C 27/006 427/419.7
2014/0308513 A1 10/2014 Miura

FOREIGN PATENT DOCUMENTS

DE 27 33 602 A1 2/1979
DE 2733602 A * 2/1979 ..... A44C 27/00
JP H3-136604 A 6/1991

(Continued)

OTHER PUBLICATIONS

Extended European Search Report issued on May 3, 2022 for corresponding European Patent Application No. 21205235.1 (9 pages).

(Continued)

*Primary Examiner* — Anthony M Liang
*Assistant Examiner* — Jacob J Gusewelle
(74) *Attorney, Agent, or Firm* — Hauptman Ham, LLP

(57) ABSTRACT

A jewelry item includes a thin piece member formed from a gold alloy containing gold (Au) as a first metal element and a second metal element other than gold (Au), a frame member including a third metal element other than the first metal element and the second metal element and a fourth metal element as a metal for an alloy of the third metal, forming a bond with and surrounding a peripheral edge of the thin piece member, and a compound layer containing the first metal element, the second metal element, the third metal element and the fourth metal element is interposed between the thin piece member and the frame member.

10 Claims, 24 Drawing Sheets

(56) References Cited

FOREIGN PATENT DOCUMENTS

| | | | | |
|---|---|---|---|---|
| JP | H5-228609 | A | 9/1993 | |
| JP | H11-264036 | A | 9/1999 | |
| JP | 2002-536541 | A | 10/2002 | |
| JP | 2003-183710 | A | 7/2003 | |
| JP | 2006-167128 | A | 6/2006 | |
| JP | 2011-239877 | A | 12/2011 | |
| JP | 2012-35304 | A | 2/2012 | |
| JP | 2018-21243 | A | 2/2018 | |
| WO | 00/46413 | A1 | 8/2000 | |
| WO | WO-2010067422 | A1 * | 6/2010 | ..... C23C 18/48 |

OTHER PUBLICATIONS

Office Action issued on Aug. 3, 2021 for corresponding Japanese Patent Application No. 2021-109116, along with an English machine translation.

* cited by examiner

JEWELRY ITEM AND METHOD FOR MANUFACTURING JEWELRY ITEM

CROSS-REFERENCE TO RELATED APPLICATIONS

This application is based upon and claims the benefit of priority from the prior Japanese Patent Application No. 2021-109116, filed on Jun. 30, 2021, the entire contents of which are incorporated herein by reference.

FIELD

One embodiment of the present invention relates to the structure of a jewelry item including a plurality of metal materials and a method for manufacturing a jewelry item including a plurality of metal materials.

Gold (Au) is a precious metal and is widely used in jewelry applications. Gold (Au) usually shines in a gold color, but a gold alloy called colored gold is also used to create unique and original accessories and jewelries in the field of jewelry. There are several types of gold alloys called yellow gold, pink gold, and so on. Among these, a gold-aluminum alloy called purple gold is known (for example, refer to PCT International Publication No. WO2000/046413, Japanese Unexamined Patent Application Publication No. H11-264036, and PCT International Publication No. WO2010/067422).

Since purple gold is hard, non-ductile, and brittle, it is necessary to have a thickness of, for example, 1 mm or more when used in jewelry item. Also, to make jewelry item larger than 100 $mm^2$, it needs to be protected with a frame or made thicker. Therefore, jewelry item which has a large shape, or a complicated design has a problem whereby the number of parts increases, the processing time becomes long, and the weight increases.

As a result, it was sometimes considered that the jewelry item made of purple gold was heavier, less comfortable, and more expensive than it appears. In order to reduce weight, the design must be simplified, and since the size is limited, the variety of products is limited, and the jewelry item using purple gold is inferior in price competitiveness compared with other color gold jewelry.

SUMMARY

A jewelry item in an embodiment according to the present invention includes a thin piece member formed from a gold alloy containing gold (Au) as a first metal element and a second metal element other than gold (Au), a frame member including a third metal element other than the first metal element and the second metal element and a fourth metal element as a metal for an alloy, and forming a bond with and surrounding the peripheral edge of the thin piece member, and a compound layer containing the first metal element, the second metal element, the third metal element, and the fourth metal element interposed between the thin piece member and the frame member.

A method for manufacturing a jewelry item in an embodiment according to the present invention, the method includes injecting a molten gold alloy containing gold (Au) as a first metal element and a second metal element other than gold (Au) into a casting mold wherein the casting mold is formed by a frame member containing a third metal element other than the first metal element and the second metal element and a fourth metal element as a metal for an alloy, and a cavity for exposing a side surface of the frame member, cooling the casting mold after the molten gold alloy is injected, and forming a compound layer containing the first metal element, the second metal element, the third metal element, and the fourth metal element between the frame member and the thin piece member formed from the molten gold alloy in the casting mold.

DESCRIPTION OF EMBODIMENTS

Figure 1A:
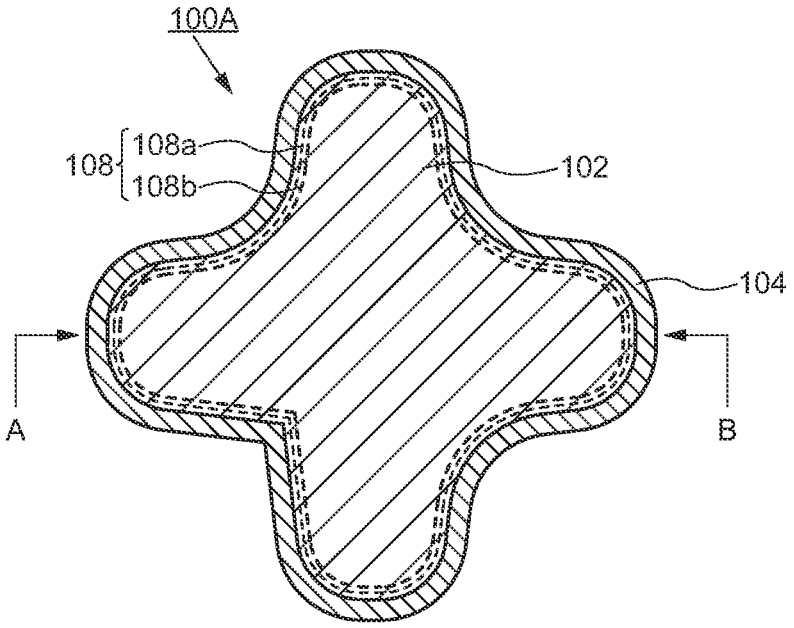
FIG. 1A shows a plan view of a jewelry item according to an embodiment of the present invention.

Hereinafter, embodiments of the present invention will be described with reference to the drawings and the like. The present invention may be carried out in various forms without departing from the gist thereof, and is not to be construed as being limited to any of the following embodiments. Although the drawings may schematically represent the width, thickness, shape, and the like of each part in comparison with the actual embodiment in order to clarify the description, they are merely examples and do not limit the interpretation of the present invention. In the present specification and each of the figures, elements similar to those already described previously with respect to the figures are designated by the same reference numerals (or numbers followed by A, B, or a, b, etc.), and a detailed description thereof may be omitted as appropriate. Furthermore, the characters "first" and "second" appended to each element are convenient signs used to distinguish each element, and have no further meaning unless specifically described.

Structure of Jewelry Item

In this section, a structure of a jewelry item according to an embodiment of the present invention will be described in detail while referring to the drawings.

First Embodiment

Figure 1B:
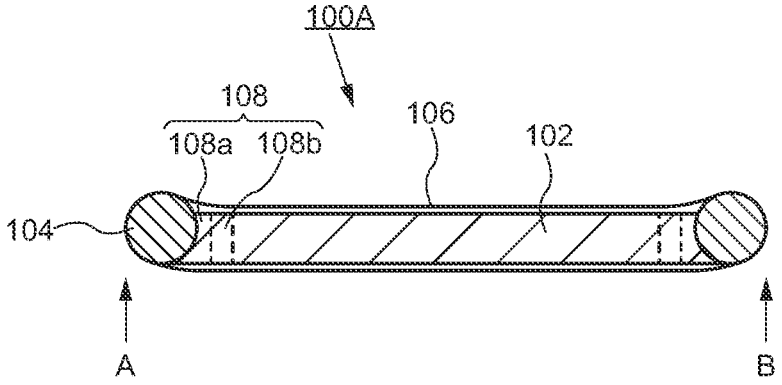
FIG. 1B shows a cross-sectional view corresponding to a section between A and B in the plan view shown in FIG. 1A of the jewelry item according to an embodiment of the present invention.

FIG. 1A and FIG. 1B show a configuration of a jewelry item 100A according to an embodiment of the present invention. FIG. 1A shows a plan view of the jewelry item 100A. FIG. 1B shows a cross-sectional view of the jewelry item 100A corresponding to the section between A-B shown in the plan view.

As shown in FIG. 1A, the jewelry item 100A includes a thin piece member 102 formed of a gold alloy and having an arbitrary shape, and a frame member 104 formed of metal to surround a peripheral part of the thin piece member 102. The shape of the thin piece member 102 in a plan view is arbitrary and may have a shape which is designed based on an arbitrary motif or may have a geometric shape. As shown in FIG. 1B, the thin piece member 102 has a shape similar to or thinner than a thickness (or diameter) of the frame member 104 in a cross-sectional view. Although FIG. 1B shows a shape in which the thin piece member 102 is flat, the jewelry item 100A is not limited to the illustrated cross-sectional shape, and may be formed to have a curved shape in a cross-sectional view.

The jewelry item 100A may have a protective film 106 formed on a surface of the thin piece member 102 as shown in FIG. 1B. The protective film 106 is a transparent inorganic insulating film, for example, formed of a silica glass film. The silica glass film as the protective film 106 has a thickness of 0.2 μm to 1.0 μm. The thin piece member 102 is covered with the protective film 106 to prevent discoloration and damage by friction or the like.

The frame member 104 is a linearly shaped member and is arranged to surround a peripheral portion of the thin piece member 102 having a flower shape in a plan view, for example. FIG. 1A shows a shape in which the frame member 104 has an annular shape and surrounds an entire circumference of the thin piece member 102. The frame member 104 is arranged so as to surround the entire periphery portion of the thin piece member 102 in order to prevent damage of the jewelry item 100A and to provide a rugged structure. However, the frame member 104 may have a shape that surrounds a portion of the thin piece member 102 and does not surround another portion (a shape that does not surround the entire periphery portion), depending on the design of the jewelry item 100A. The surface of the frame member 104 may be provided with a predetermined surface finish and may be provided with a design.

A compound layer 108 is arranged to between in an area where the thin piece 102 and the frame member 104 are bonded. The compound layer 108 contains both metal components of metal elements contained in the thin piece member 102 and metal elements contained in the frame member 104. In other words, the compound layer 108 may be an alloy layer containing a plurality of metal elements. The compound layer 108 is formed to extend from a boundary between the frame member 104 and the thin piece member 102 to the inside of the thin piece member 102. A width of the compound layer 108 is small relative to a size of the thin piece member 102, and has a width of 1 mm or less, for example, about 0.5 mm.

The compound layer 108 has a composition different from that of the thin piece member 102 and the frame member 104, and therefore the compound layer 108 has a different hue in appearance from that of the thin piece member 102 and the frame member 104. The compound layer 108 is expected to be an intermetallic compound, and forms a region having a hardness higher than that of the thin piece member 102 and the frame member 104.

It is possible to confirm that there is a plurality of layers by observing the compound layer 108 in detail. That is, the compound layer 108 may be divided into a first compound layer 108*a* and a second compound layer 108*b*, as shown in FIG. 1A and FIG. 1B. The first compound layer 108*a* is a layer on the frame member 104 side, and the second compound layer 108*b* is a layer on the thin piece member 102 side. The first compound layer 108*a* and the second compound layer 108*b* commonly contain both metal components of the metal elements contained in the thin piece member 102 and the metal elements contained in the frame member 104. The first compound layer 108*a* has a high ratio of metal elements contained in the frame member 104, and the second compound layer 108*b* has a high ratio of metal elements contained in the thin piece member 102. The boundary between the first compound layer 108*a* and the second compound layer 108*b* may not necessarily be clearly defined.

The thin piece member 102 contains gold (Au) as a first metal element and at least one kind of a second metal element other than gold (Au). In this embodiment, the second metal element is typically aluminum (Al). That is, gold (Au) constituting the thin piece member 102 is 18 Karat gold (K18), and aluminum (Al) is contained as a metal for making an alloy. The gold-aluminum (Au—Al) alloy has a bright purple hue and is called "purple gold". Also, indium (In) or gallium (Ga) may be selected as the second metal element. The gold-indium (Ag—In) alloy and the gold-gallium (Au—Ga) alloy have a blue hue and are called "aqua gold".

In the present embodiment, the frame member 104 includes a third metal element other than the first metal element and the second metal element. The frame member 104 preferably contains a fourth metal element in addition to a third metal element. For example, the frame member 104 may contain platinum (Pt) as the third metal element and palladium (Pd) as the fourth metal element. The fourth metal element is selected from a metal for forming an alloy with platinum (Pt) which is the third metal element. It is preferable to use platinum containing the fourth metal element rather than pure platinum, when the frame member 104 is made of platinum. For example, the frame member 104 preferably uses platinum 900 (Pt 90%, Pd 10%) and may be replaced with platinum 950 (Pt 95%, Pd 5%) or platinum 850 (Pt 85%, Pd 5%). Ruthenium (Ru) may be used as the fourth metal element to be added to platinum (Pt).

The compound layer 108 contains gold (Au), aluminum (Al), platinum (Pt), and palladium (Pd) as metal elements when the thin piece member 102 is made from a gold-aluminum (Au—Al) alloy (purple gold) and the frame member 104 is made from platinum 900. In other words, the compound layer 108 is an alloy layer containing gold (Au), aluminum (Al), platinum (Pt), and palladium (Pd).

As schematically shown in FIG. 1A and FIG. 1B, when the compound layer 108 includes two regions, the first compound layer 108*a* on the side close to the frame member 104 and the second compound layer 108*b* on the side close to the thin piece member 102 commonly include metal elements forming the thin piece member 102 and metal elements forming the frame member 104. However, the first compound layer 108*a* and the second compound layer 108*b* differ in the composition ratio of those metal elements included in common. That is, the first compound layer 108*a* and the second compound layer 108*b* commonly contain gold (Au), aluminum (Al), platinum (Pt), and palladium (Pd), but the composition ratios of these metal elements are different. The first compound layer 108*a* is a region containing 50 wt. % or more of metal components (Au, Al) constituting the thin piece member 102 and less than 50 wt. % of components (Pt, Pd) of the frame member 104, when the composition ratio is expressed by weight percentage. The second compound layer 108*b* is a region containing 60 wt. % or more of metal components (Au, Al) constituting the thin piece member 102 and less than 40 wt. % of components (Pt, Pd) of the frame member 104.

The compound layer 108 including both the metal elements constituting the thin plate member 102 and the metal elements constituting the frame member 104 is an alloy region, and differs not only in composition but also in mechanical properties. For example, the compound layer 108 is a harder region than the thin piece member 102 and the frame member 104. The jewelry item 100A according to the present embodiment has the compound layer 108 having hard properties along the frame member 104 surrounding the thin piece member 102, so that a robust structure can be achieved. Since the compound layer 108 is the alloy containing the metal elements constituting the thin piece member 102 and the metal elements constituting the frame member 104, the thin piece member 102 can be bonded to the frame member 104 with high adhesion, and it is possible to provide a durable jewelry item 100A.

Generally, laser welding, brazing, and the like are used when bonding different metals. However, it takes a long time to bond different kinds of metals to delicate and complicated shapes such as jewelry item by laser welding or brazing. In addition, it is necessary to carry out careful and detailed work to attach a thin piece member made of a precious metal to the bezel by using a claw, resulting in a long processing time. On the other hand, it is possible to provide a durable jewelry item having high bonding strength by forming the compound layer 108 when the thin piece member 102 and the frame member 104 of different metals are bonded together, as shown in this embodiment. Further, since the thin piece member 102 is directly bonded to the frame member 104 via the compound layer 108, the conventional frame fitting work is not required, and the processing time can be shortened. The bonding technique according to the present embodiment may also be applied to the gold-aluminum (Au—Al) alloy called purple gold, so that the price competitiveness of jewelry item using purple gold can be promoted.

Second Embodiment

Figure 2A:
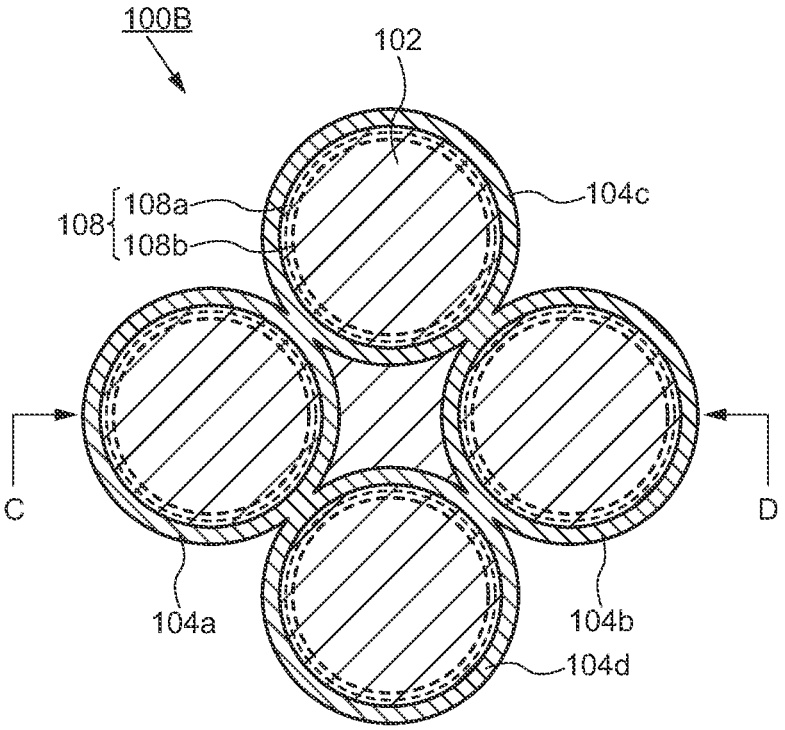
FIG. 2A shows a plan view of a jewelry item according to an embodiment of the present invention.
Figure 2B:
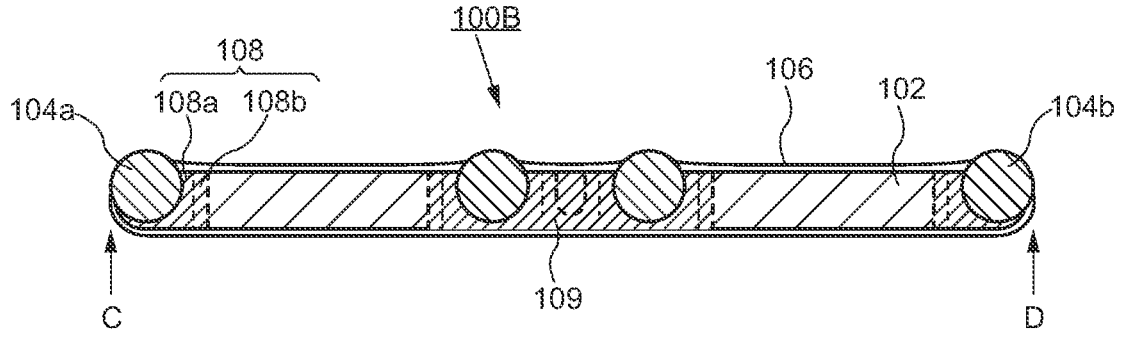
FIG. 2B shows a cross-sectional view corresponding to a section between A and B in the plan view shown in FIG. 2A of the jewelry item according to an embodiment of the present invention.

FIG. 2A and FIG. 2B show an example of a jewelry item 100B in which the shape of the frame member 104 is different from the jewelry item 100A shown in the first embodiment. FIG. 2A shows a plan view of the jewelry item 100B, and FIG. 2B shows a cross-sectional view of the jewelry item 100B corresponding to the section between C-D shown in the plan view.

The jewelry item 100B shown in FIG. 2A is arranged such that the frame member 104 does not surround only the outer portion of the jewelry item 100B but also partitions the thin piece member 102 in the inner portion. FIG. 2A shows, for example, the jewelry item 100B having a design in which a plurality of circles is combined. The jewelry item 100B has a shape in which adjacent circles are arranged with each other, and the adjacent circles are bonded with each other at the contact portions to be integrated. The outline of the circles is formed by frame members 104 (a first frame member 104*a*, a second frame member 104*b*, a third frame member 104*c*, and a fourth frame member 104*d*). This shape has a region surrounded by four frame members 104 (the first frame member 104*a*, the second frame member 104*b*, the third frame member 104*c*, and the fourth frame member 104*d*) having the circular shape in the center portion of the jewelry item 100B, as shown in FIG. 2B.

The thin piece member 102 is arranged to fill the inside of the frame members 104 (the first frame member 104*a*, the second frame member 104*b*, the third frame member 104*c*, and the fourth frame member 104*d*) and the region surrounded by these frame members. Specifically, the thin piece member 102 is arranged to fill the inner portion of the circle of the first frame member 104*a*, the inner portion of the circle of the second frame member 104*b*, the inner portion of the circle of the third frame member 104*c*, the inner portion of the circle of the fourth frame member 104*d*, and the center portion surrounded by the first frame member 104*a*, the second frame member 104*b*, the third frame member 104*c*, and the fourth frame member 104*d*. The first frame member 104*a* and the second frame member 104*b* are not in direct contact with each other, but are arranged close to each other, as shown in FIG. 2B. Although not shown in the diagram, the third frame member 104*c* and the fourth frame member 104*d* have the same arrangement.

As shown FIG. 2A, the jewelry item 100B having the plurality of frame members 104 (the first frame member 104*a*, the second frame member 104*b*, the third frame member 104*c*, and the fourth frame member 104*d*) unified may have a portion where several frame members are arranged in proximity. Although FIG. 2A and FIG. 2B show a relatively simple configuration in which only circles are arranged, an actual jewelry item may have a complex design, such as a flower pattern, and has a configuration with a plurality of frame members arranged in a complex manner to represent flower petals.

The jewelry item 100B shown in FIG. 2A and FIG. 2B also has the compound layer 108 formed at the portion between the thin piece member 102 and the frame members 104 (the first frame member 104*a*, the second frame member 104*b*, the third frame member 104*c*, and the fourth frame member 104*d*). The compound layer 108 has certain widths from the respective ends of the frame members 104 (the first frame member 104*a*, the second frame member 104*b*, the third frame member 104*c*, and the fourth frame member 104*d*), and is formed along the edges thereof. However, the compound layer is continuous in the center portion adjacent to the first frame member 104*a*, the second frame member 104*b*, the third frame member 104*c*, and the fourth frame member 104*d* to form the second compound layer 109 having a certain area.

FIG. 2B schematically shows this state. That is, FIG. 2B shows that a compound layer 108 is formed at the boundary between the first and second frame members 104*a*, 104*b* and the thin film member 102. On the other hand, the second compound layer 109 is formed in the center portion where the first frame member 104*a* and second frame member 104*b* are close to each other, alloyed and connected as one. The second compound layer 109 is a region in which the metal elements containing the thin piece member 102 and the metal elements containing the frame members 104 (the first frame member 104*a*, the second frame member 104*b*, the third frame member 104*c*, and the fourth frame member 104*d*) are mixed, and is formed in a relatively wide range on the back surface side of the jewelry item 100B. The second compound layer 109 is not a region in which the metal elements are uniformly mixed, but has a state in which portions corresponding to the first compound layer 108*a* and portions corresponding to the second compound layer 108*b* described in the first embodiment are randomly mixed. The state of the second compound layer 109 is visible on the exterior, with gray or silvery-white areas (the first compound layer 108*a*) and golden or yellowish silver areas (the second compound layer 108*b*), enhancing the design of the jewelry item 100B.

The formation of the second compound layer 109 as illustrated in FIG. 2A and FIG. 2B is also considered to be influenced by the manufacturing process of the jewelry item 100B. The jewelry item 100A and the jewelry item 100B are manufactured by casting, as will be described later. When casting, a sprue runner is formed in the casting mold so that it flows to the center area of a solid pattern, and the molten high-temperature gold alloy is poured into the area where the frame members 104 (the first frame member 104*a*, the second frame member 104*b*, the third frame member 104*c*, and the fourth frame member 104*d*) are assembled. Since the distance between the first frame member 104*a*, the second frame member 104*b*, the third frame member 104*c*, and the fourth frame member 104*d* is narrow in the center portion of the solid pattern, it is considered that the metal forming the frame members 104 melts into the molten high-temperature gold alloy to form the second compound layer 109 in a relatively wide range.

The second compound layer 109 is an alloy of the metal elements containing the thin piece member 102 and the metal elements containing the frame members 104 (the first frame member 104*a*, the second frame member 104*b*, the third frame member 104*c*, and the fourth frame member 104*d*). The thin piece member 102 is firmly bonded to the frame members 104 (the first frame member 104*a*, the second frame member 104*b*, the third frame member 104*c*, and the fourth frame member 104*d*) by the compound layer 108 and the second compound layer 109. As a result, the jewelry item 100B can be made durable as in the first embodiment. The jewelry item 100B has the second compound layer 109 formed in the center portion of the body. Therefore, it is possible to provide a durable jewelry item 100B that can withstand practical use even when the jewelry item 100B has a relatively large shape of about 100 $mm^2$ or more.

Method for Manufacturing Jewelry Item

In this section, a method for manufacturing the jewelry item according to an embodiment of the present invention will be described in detail with reference to the drawings. This embodiment shows a method for manufacturing the jewelry item 100A by a method called a lost wax method (also called a wax casting method or a lost wax casting method).

Making Solid Pattern Using Sheet Waxes

Figure 3A:
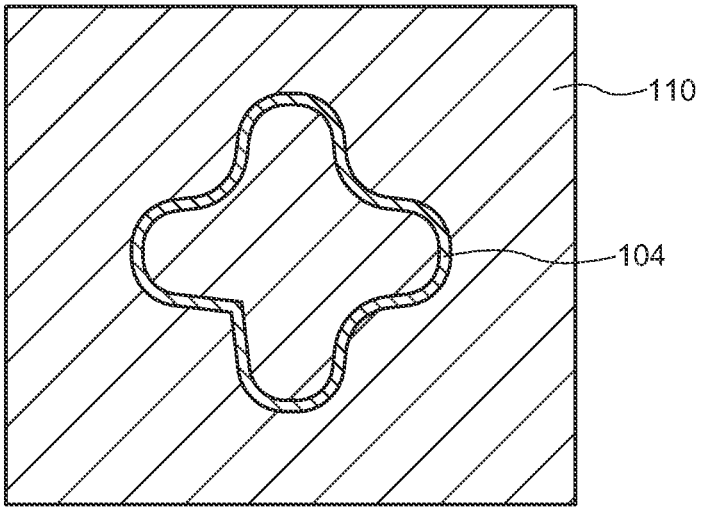
FIG. 3A shows a method for manufacturing a jewelry item according to an embodiment of the present invention and shows a state in which a frame member overlapped a sheet wax.
Figure 3B:
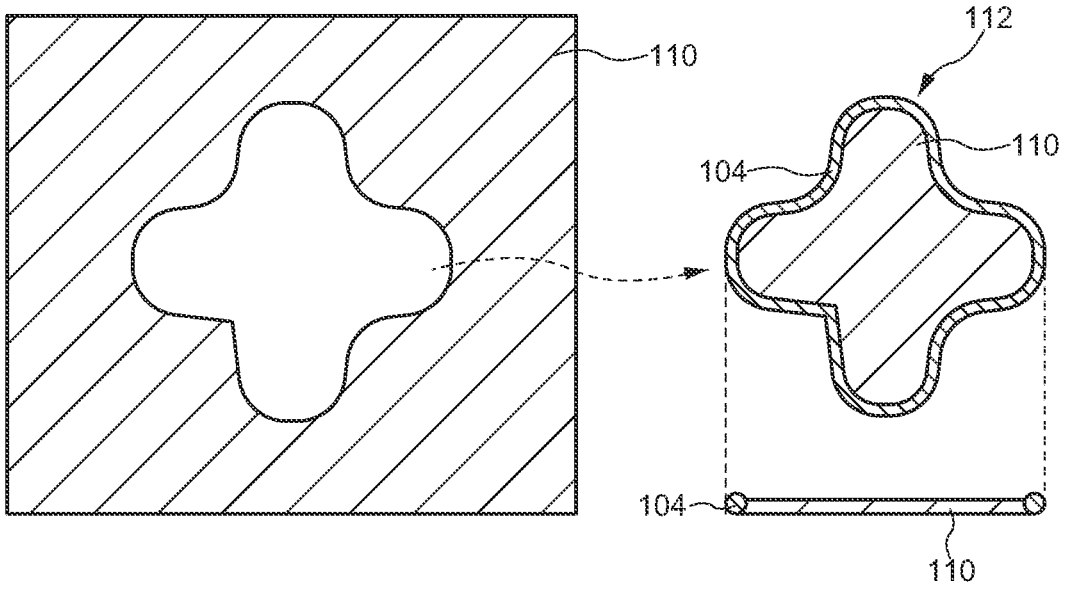
FIG. 3B shows a method for manufacturing a jewelry item according to an embodiment of the present invention, and shows a state in which the frame member is cut with a sheet wax attached thereto.

FIG. 3A and FIG. 3B show a method of making a solid pattern using a sheet wax. FIG. 3A shows a state in which the frame member 104 is overlaid on the sheet wax 110. The sheet wax 110 contains paraffin as a main component. The sheet wax 110 has a low melting point (about 60° C.) and has a property in which it volatilizes and disappears when heated to a high temperature. The sheet wax 110 has flexibility, and can be formed into a shape according to the shape of the frame member 104. The thickness of the sheet wax 110 can be selected as appropriate, for example, a thickness of 0.5 mm to 1.0 mm is used. The frame member 104 is pressed against the sheet wax 110 so that it is slightly embedded. Then, the sheet wax 110 is cut out according to the outline of the frame member 104, and then taken while the sheet wax 110 is adhered to the inside of the frame member 104.

FIG. 3B shows a state in which the sheet wax 110 is adhered to the frame member 104 and is cut out. The sheet wax 110 is taken out while adhered to the inside of the frame member 104. A metal surface may be exposed on the front surface side of the frame member 104, and the wax material may be thinly adhered to the back surface of the frame member 104. In this way, a solid pattern 112 of the jewelry item 100A is prepared.

Figure 4A:
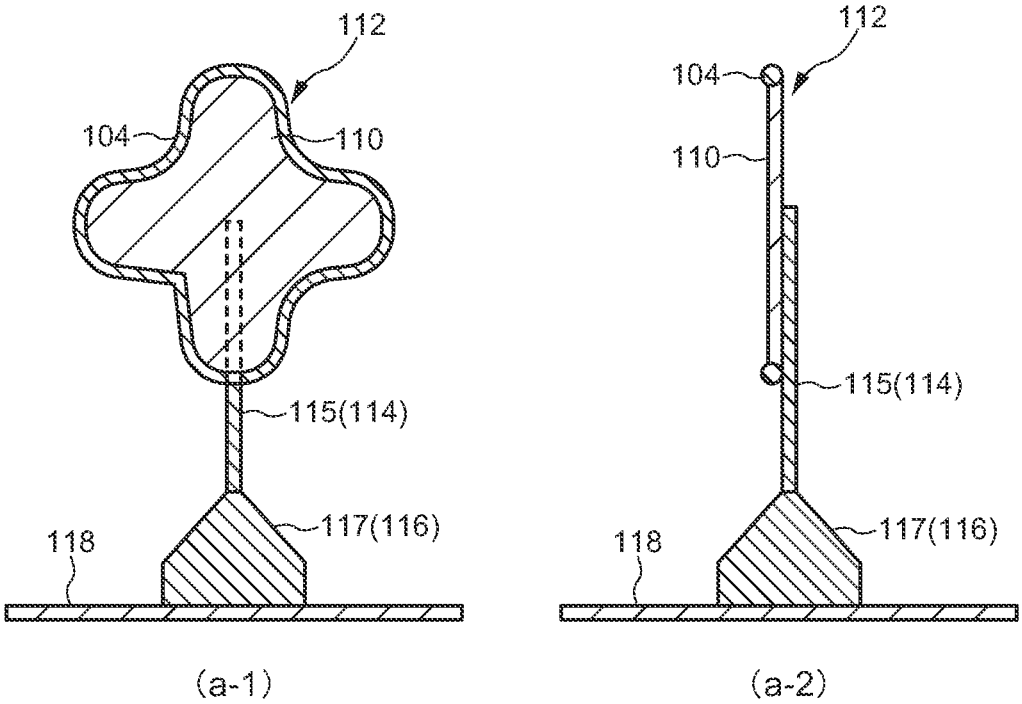
FIG. 4A shows a method of manufacturing a jewelry item according to an embodiment of the present invention and shows a step of providing a sprue runner connected to a master pattern formed of the frame member and the sheet wax.

FIG. 4A shows a steps of forming a sprue runner 114 and a down sprue 116 connected to the solid pattern 112. FIG. 4A shows a front view (a-1) and a side view (a-2).

A wax material is used for forming the sprue runner 114 and the down sprue 116. The wax material 115 forming the sprue runner 114 is rod-shaped, and is fixed by welding with one side abutting on the back surface of the solid pattern 112. Although FIG. 4A shows the sprue runner 114 being attached parallel along the back of the solid pattern 112, the attachment of the sprue runner 114 is not limited to this example, and it may be attached so that the tip of the sprue runner 114 is perpendicular to the back of the solid pattern 112. The other end of the sprue runner 114 is connected to the wax material 117 that forms the down sprue 116. The wax material 117 forming the down sprue 116 has a columnar or conical shape having a relatively large diameter so that the molten gold alloy can be easily poured. The solid pattern 112, to which the wax material 115 forming the sprue runner 114 is connected, and is placed on a sheet 118 made of paper or plastic. Although FIG. 4A shows one solid pattern 112 attached to the down sprue 116, it is not limited to the illustrated form, and a plurality of prototypes 112 may be attached to the down sprue 116 in a tree shape.

Making Solid Pattern With Injection Wax

Although FIG. 3A, FIG. 3B, and FIG. 4A illustrate the method of making the solid pattern 112 using the sheet wax 110, the solid pattern 112 may be made by other methods. The method of making the solid pattern 112 using injection wax is described below.

Figure 5A:
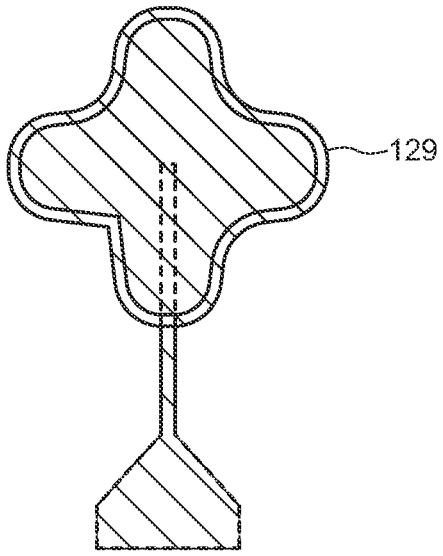
FIG. 5A shows a method for manufacturing a jewelry item according to an embodiment of the present invention and shows a solid pattern for a rubber mold.

FIG. 5A shows a solid pattern 129 for a rubber mold. The solid pattern 129 for the rubber mold is made of a metal such as silver (Ag). The solid pattern 129 for the rubber mold may have a shape in which the jewelry item and the part which becomes the sprue runner are integrated, and further includes a shape of the part which becomes the down sprue at the tip of the sprue runner.

Figure 5B:
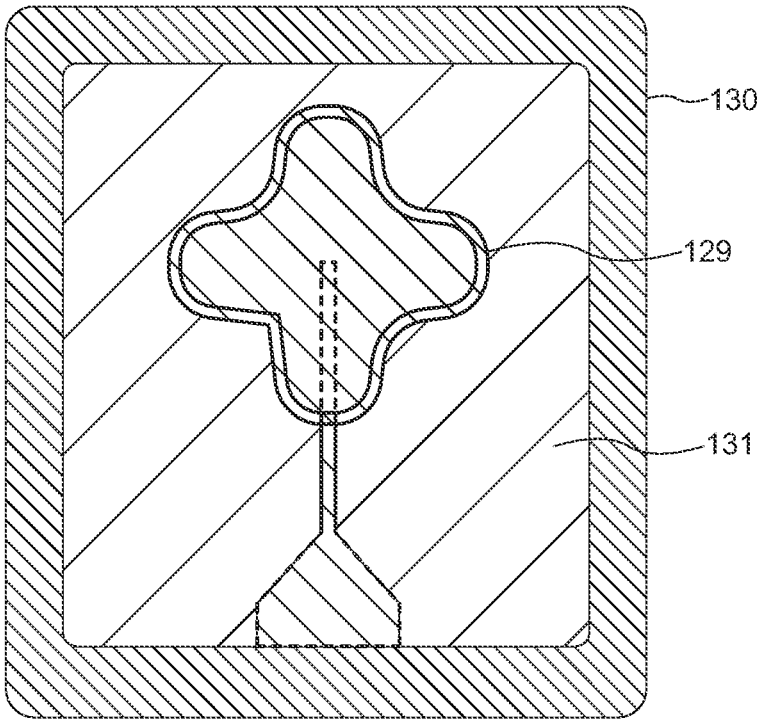
FIG. 5B shows a method for manufacturing a jewelry item according to an embodiment of the present invention, and shows a state in which the solid pattern for the rubber mold is placed in the mold and filled with silicone rubber.

FIG. 5B shows a state in which the solid pattern 129 for the rubber mold placed in a metal (for example, aluminum) formwork 130 is placed in a casting investing material 131. For example, liquid-state silicone rubber is used as the casting investing material 131. A thermosetting silicone rubber (HTV rubber) or a two-component silicone rubber (RTV rubber) can be used as the liquid silicone rubber.

In the case where the thermosetting silicone rubber (HTV rubber) is used, at first, about half of the thermosetting silicone rubber is spread on the formwork 130 as the casting investing material 131, and the solid pattern 129 for the rubber mold is placed thereon, and then the silicone rubber is put on the formwork 130 without any gap. The rubber mold 132 is prepared by sandwiching the solid pattern 129 for the rubber mold with silicone rubber as the casting investing material 131, and setting it in a hot press machine and curing (vulcanizing) it.

In the case when the two-component silicone rubber is used, the solid pattern 129 for the rubber mold is set in the formwork 130, and the liquid-state silicone rubber mixed with the main agent and a curing agent is poured, defoamed, and naturally cured to prepare the rubber mold 132.

Figure 6A:
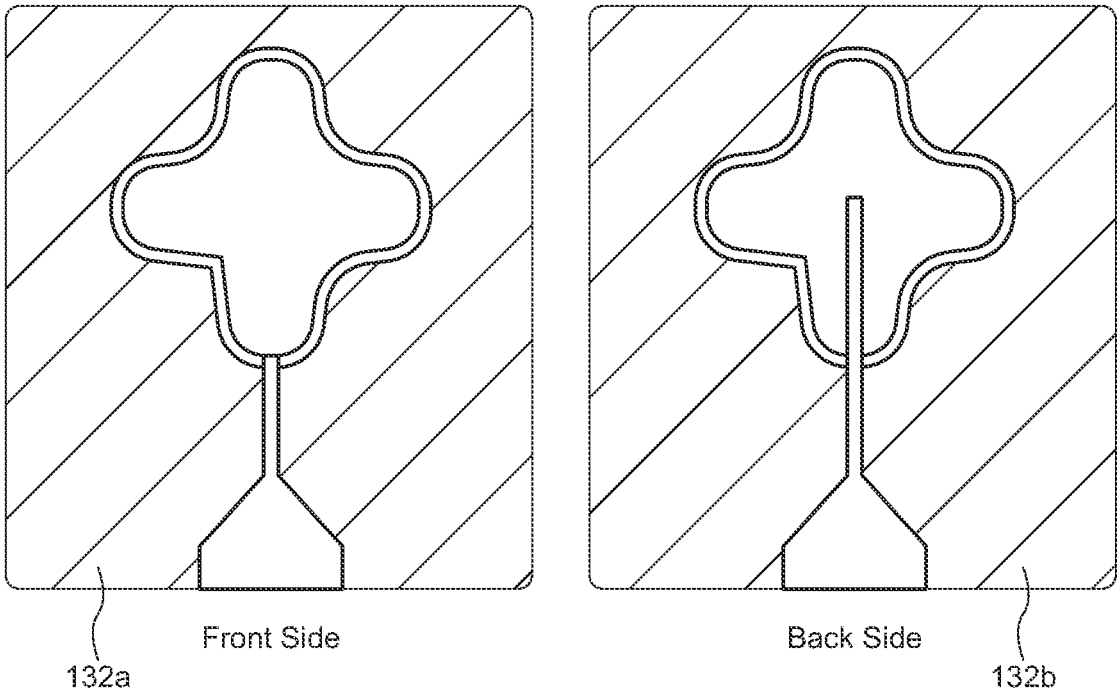
FIG. 6A shows a method for manufacturing a jewelry item in one embodiment of the present invention, and shows an inner surface of a front portion and an inner surface of a back portion of the rubber mold cut front to back.

FIG. 6A shows a state in which the cured rubber mold 132 is separated and the solid pattern 129 for the rubber mold is taken out. The rubber mold 132 is cut open by a scalpel with a step so as not to collapse the mold. FIG. 6A shows an inner surface of a front portion and an inner surface of a back portion of the rubber mold 132 cut open from front and back. The part where the solid pattern 129 for the rubber mold is taken out becomes a cavity, and a space for injecting the injection wax is formed. The example shown in FIG. 6A shows an embodiment in which a part which becomes the solid pattern of the jewelry item and a shape of a part which becomes the sprue runner, and the down sprue are formed in the rubber mold 132.

Figure 6B:
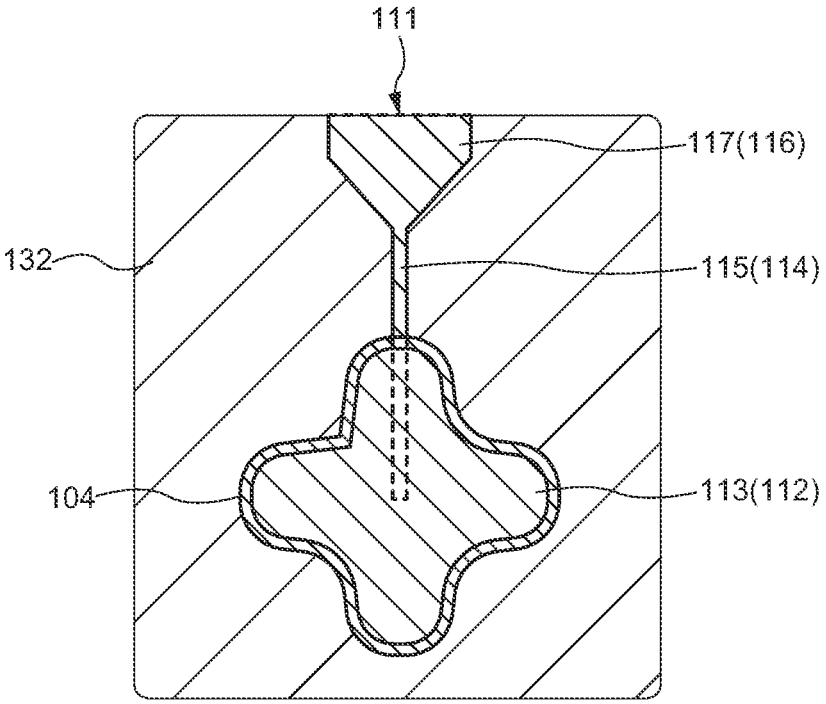
FIG. 6B shows a method for manufacturing a jewelry item according to an embodiment of the present invention, and shows a state in which wax is injected into the rubber mold.

FIG. 6B shows a state in which the injection wax 111 is poured into the rubber mold 132. The injection wax 111 contains paraffin as a main component similar to the sheet wax 110. The frame member 104 is set in the cavity inside the rubber mold 132, and the injection wax 111 of a molten state is poured into the rubber mold 132. When the injection wax 111 hardens, a wax member 113 forming the solid pattern 112 of the jewelry item, a wax member 115 forming the sprue runner 114, and a wax member 117 forming the down sprue 116 are formed. Thereafter, when the rubber mold 132 is separated, the solid pattern 112 having the same shape as that shown in FIG. 4A is fabricated.

Fabrication of Jewelry Item by Casting

Figure 4B:
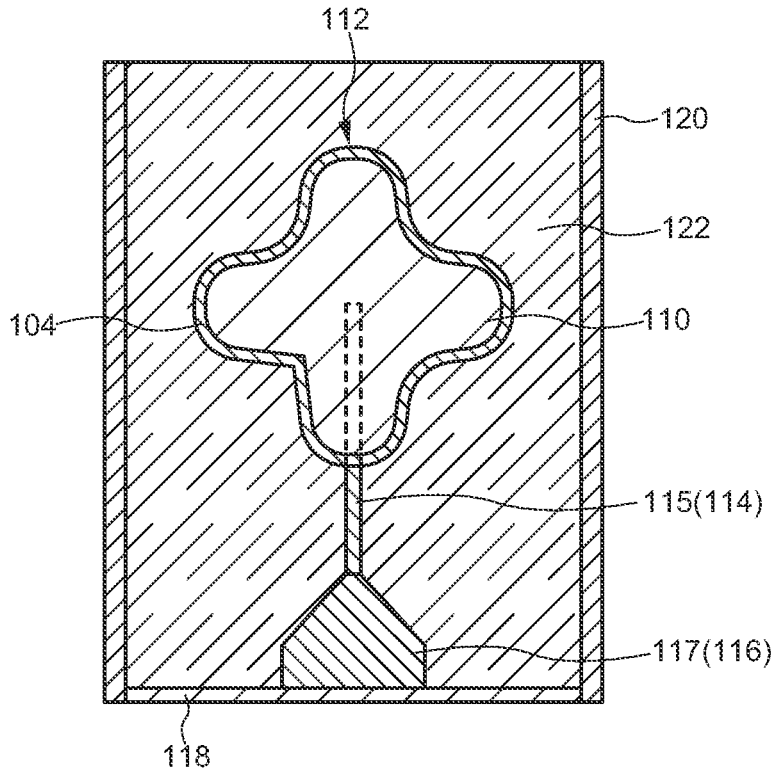
FIG. 4B shows a method for manufacturing a jewelry item according to an embodiment of the present invention, and shows a step of embedding the pattern, the sprue runner, and a down sprue with an investment.

FIG. 4B shows a step of forming the casting mold. The solid pattern 112 to which the wax material 115 forming the sprue runner 114 and the wax material 117 forming the down sprue 116 are connected is placed on the sheet 118, and a metal cylinder 120 is placed to enclose the solid pattern 112. Then, a casting investing material 122 is poured into the cylinder 120. The gypsum slurry is used as the casting investing material 122. Silica may be used instead of the gypsum as the material of the casting investing material 122.

The casting investing material 122 is poured into the cylinder 120 until the solid pattern 112 is buried. Since the lower surface of the wax material 117 forming the down sprue 116 is in contact with the sheet 118 as shown in FIG. 4B, the lower surface of the casting investing material 122 poured into the cylinder 120 and the lower surface of the down sprue 116 are flush with each other.

After the casting investing material 122 is poured into the cylinder 120, sufficient defoaming is performed and the gypsum is dried. Thereafter, baking is performed to prepare the casting mold made of the gypsum material. For example, an electric furnace is used for the baking, and heated to 700 to 1000° C.

Figure 7A:
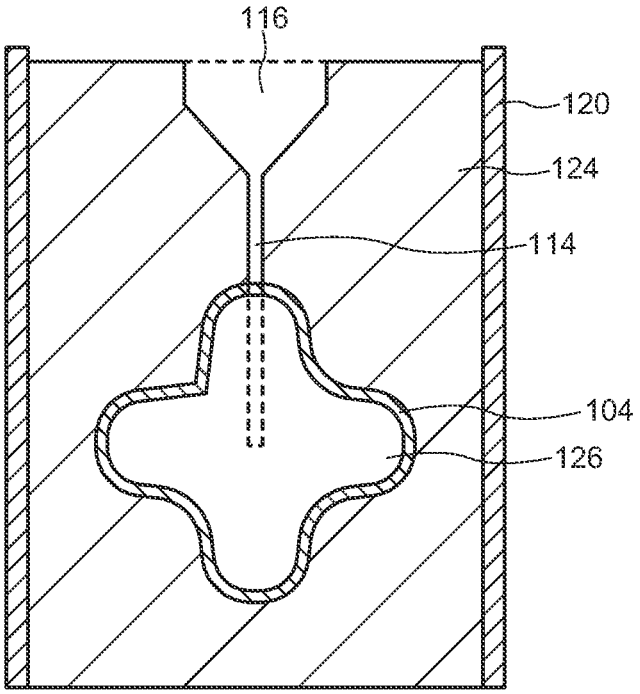
FIG. 7A shows a method for manufacturing a jewelry item according to an embodiment of the present invention, and shows a step in which wax is volatilized by firing to form a casting mold.

FIG. 7A shows a step of forming a casting mold 124 of the gypsum material after baking. The casting mold 124 is formed of the gypsum material by baking. The casting mold 124 has the down sprue 116 formed by volatilizing the wax material, the sprue runner 114, and a cavity 126 connected to the sprue runner 114. The cavity 126 corresponds to an area where the sheet wax 110 that was stretched inside the frame member 104 disappears. In other words, the cavity 126 is the cavity where the thin piece member 102 is cast. Therefore, the thickness of the cavity 126 is about 0.5 mm to 1.0 mm, the same as the thickness of the sheet wax 110. Since the frame member 104 is made of the metal materials having a heat resistance of 1000° C. or higher, the frame member 104 remains in the gypsum material while maintaining its original shape, and the cavity 126 corresponding to the shape of the lost sheet wax 110 is formed inside the frame member 104. The frame member 104 is embedded in the casting mold 124, the cavity 126 corresponding to the sheet wax of the solid pattern 112 is formed inside the frame member 104, and the sprue runner 114 and the down sprue 116 connected to the cavity 126 are formed.

Figure 7B:
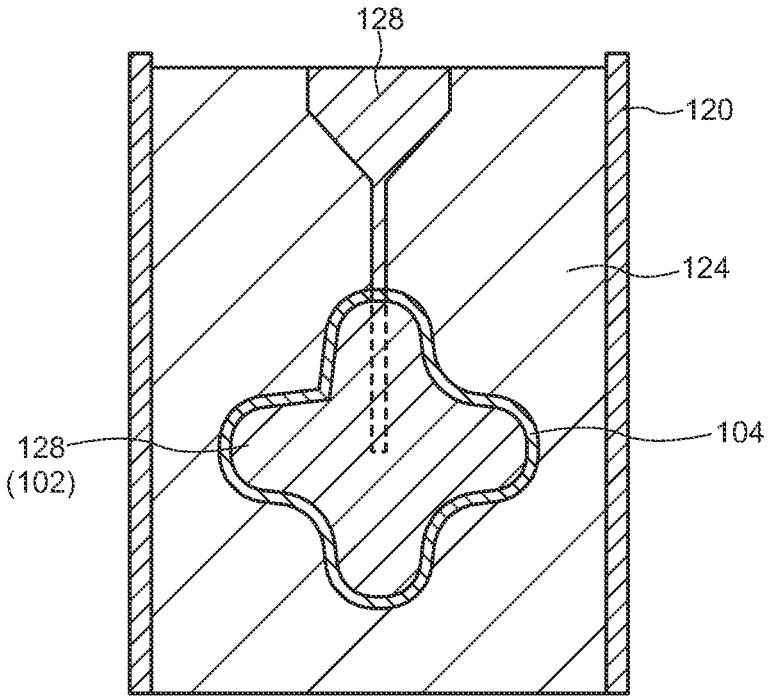
FIG. 7B shows a method for manufacturing a jewelry item according to an embodiment of the present invention, and shows a step of casting a gold alloy into the casting mold.

FIG. 7B shows a step of casting the gold alloy. The casting is performed by pouring the molten gold alloy 128, which is heated to a temperature of 1000° C. or higher, into the casting mold 124 by an injection casting method. The molten gold alloy is injected at a pressure of 0.2 MPa or higher. The molten gold alloy 128 flows through the sprue runner 114 to the cavity 126 shown in FIG. 7A. The molten gold alloy 128 poured into the cavity 126 becomes a gold alloy which forms a thin piece member (102) after cooling. After the molten gold alloy 128 is injected from the down sprue 116, the casting mold 124 is cooled. For example, the casting mold 124 is quenched in water. The casting mold 124 may be rapidly broken by this processing. The casting mold 124 may also be slowly cooled.

Figure 8A:
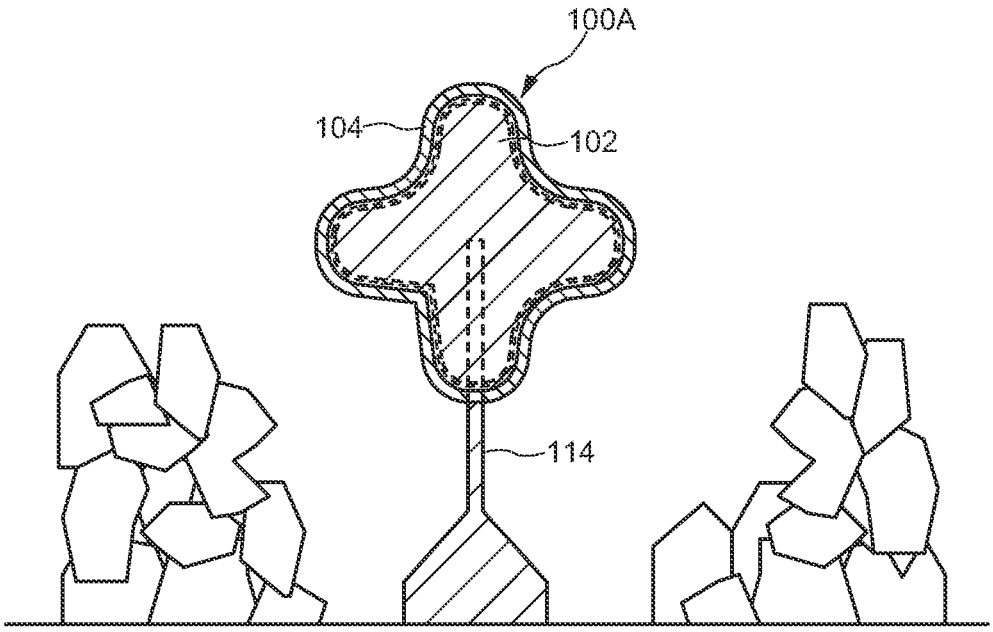
FIG. 8A shows a method for manufacturing a jewelry item according to an embodiment of the present invention, and shows a state in which the jewelry item is removed from the casting mold.

FIG. 8A shows a state in which the jewelry item 100A is removed from the casting mold 124. The jewelry item 100A has the sprue runner 114 connected to the thin piece member 102. The sprue runner 114 is removed from the thin piece member 102, and unnecessary parts such as the remains of the sprue runner 114 remaining on the thin piece member 102 are appropriately removed by polishing or the like.

The jewelry item 100A is subjected to an appropriate treatment such as polishing to finish the surface after the sprue runner 114 is removed. A protective film may be formed on the surface of the thin piece member 102 as required.

Figure 8B:
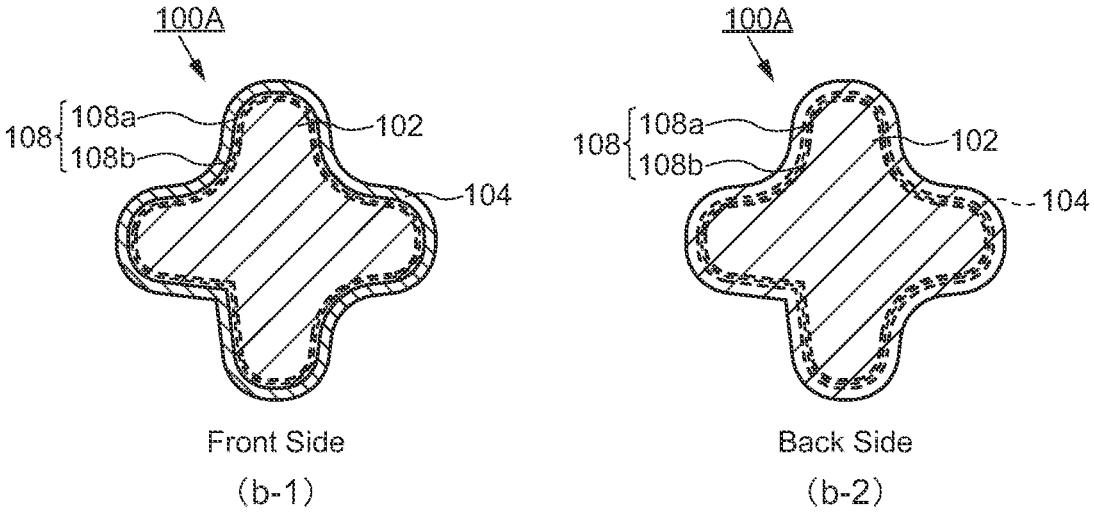
FIG. 8B shows a method for manufacturing a jewelry item according to an embodiment of the present invention, and shows the shape of the front and back of the jewelry item.

FIG. 8B shows the jewelry item 100A made by the above process. FIG. 8B, (b-1) shows the surface side of the jewelry item 100A, and (b-2) shows the back side of the jewelry item 100A. On the front side of the jewelry item 100A, the frame member 104 appears in the outline portion, and the surface of the thin piece member 102 appears inside the frame member 104. On the back side of the jewelry item 100A, the thin piece member 102 spreads over the entire back side. That is, on the back side of the jewelry item 100A, the thin piece member 102 is formed to thinly cover the surface of the frame member 104. The thin piece member 102 has a thickness of about 0.5 mm to 1.0 mm.

The compound layer 108 is formed at the part where the thin piece member 102 is bonded to the frame member 104. The compound layer 108 is formed along the inner contour of the frame member 104. The compound layer 108 is an alloy region formed of the metal elements contained in the thin piece member 102 and the metal elements contained in the frame member 104, as described with reference to FIG. 1A and FIG. 1B. It is not preferable that different metals forming the frame member 104 are mixed in the thin piece member 102 and spread all over the thin piece member 102 because the original hue of the thin piece member 102 will be lost. However, it is possible to control the width or range of the compound layer 108 by cooling the gold alloy after casting as shown in this embodiment. Thus, it is possible to increase the bonding strength between the thin piece member 102 and the frame member 104 and to prevent the hue of the compound layer 108 from affecting the hue of the entire jewelry item 100A in appearance.

From another perspective, it is possible to add a new accent to the jewelry item 100A since the compound layer 108 has a different hue from that of the thin piece member 102. That is, it is possible to enhance the designability of the jewelry item 100A since the outline is formed in the area along the frame member 104 of the thin piece member 102 in the area where the hue of the compound layer 108 differs.

In this embodiment, the thin piece member 102 is formed from the gold-aluminum (Au—Al) alloy containing 16 to 22 wt. % aluminum (Al), unavoidable impurities, and gold (Au). The gold-aluminum (Ag—Al) alloy having such a composition is called purple gold. The frame member 104 is made of platinum 900 (Pt 90%, Pd 10%). The frame member 104 may be made of platinum 850 or platinum 950 instead of platinum 900. The frame member 104 may be made of palladium (Pd).

Although the method for manufacturing the jewelry item 100A according to the first embodiment is described in this section, the jewelry item 1008 according to the second embodiment may also be manufactured by the same process.

The thin piece member 102 formed of purple gold has a purple hue. The hue of the compound layer 108 formed between the frame member 104 and the thin piece member 102 is different from that of purple gold. The details of the jewelry item using purple gold will be described below.

Characteristics of Jewelry Item Made of Purple Gold

The following describes the characteristics of the jewelry item using purple gold having the structure described in the section of the first embodiment and second embodiment and manufactured by the manufacturing method described in the section of the method for manufacturing jewelry item.

The jewelry item used in this experiment is made of platinum 900 (Pt 90%, Pd 10%) with a diameter of 1 mm as the frame member, and purple gold containing 79.8% gold (Au) and 19.4% aluminum (Al) as the thin piece member. The jewelry item is made by the manufacturing method described in the section of the method for manufacturing jewelry item.

External View

Figure 9A:
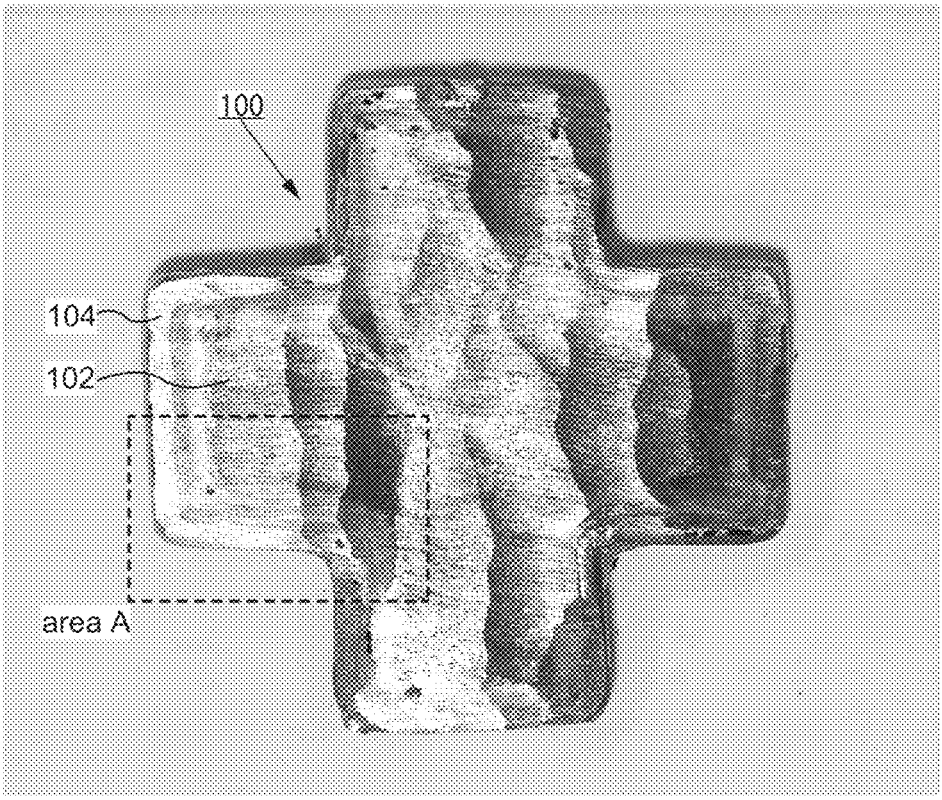
FIG. 9A shows a photograph of a jewelry item according to an embodiment of the present invention and shows a whole photograph of the front side.
Figure 9B:
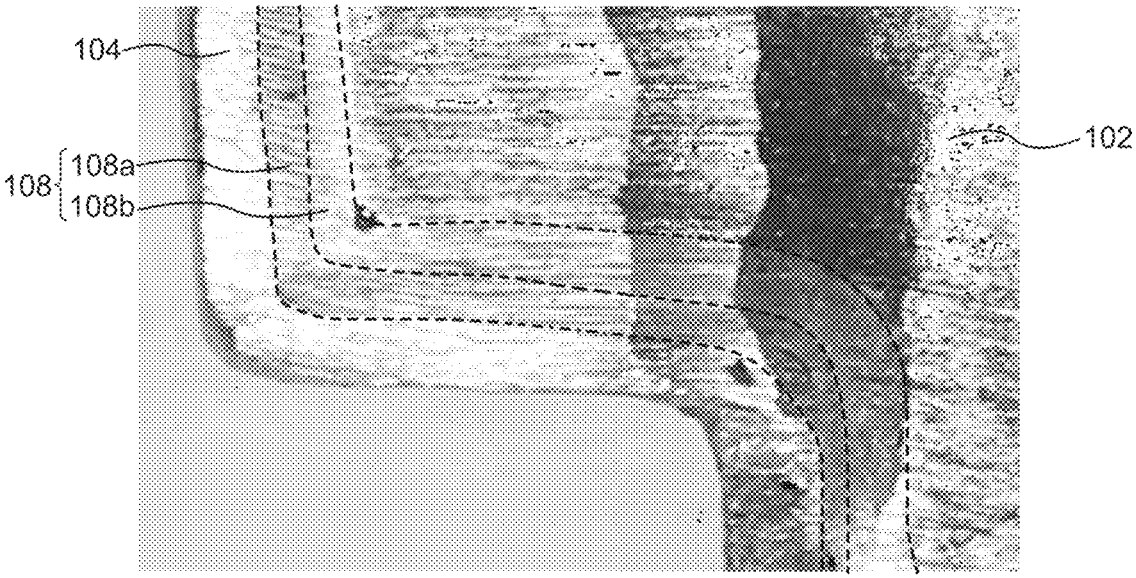
FIG. 9B shows a photograph of a jewelry item according to an embodiment of the present invention and shows a partially enlarged photograph.

FIG. 9A and FIG. 9B show photographs of the appearance of the jewelry item 100. FIG. 9A is a photograph of the entire front side of the jewelry item 100, showing that the jewelry item 100 has a cross shape. The jewelry item 100 has the thin piece member 102 formed of purple gold and the frame member 104 formed of platinum. The region of the thin piece member 102 has a purple hue and the frame member 104 has a silver hue.

FIG. 9B shows an enlarged photograph of a portion shown as "area A" and surrounded by a dotted line in FIG. 9A. As shown in the enlarged photograph of FIG. 9B, it is observed that the compound layer 108 has a different hue from the hues of the frame member 104 and the thin piece member 102. From the enlarged photograph shown in FIG. 9B, it is observed that the portion of the frame member 104 is silver, and that the first compound layer 108*a* which is slightly inside the frame member 104 has a little gloss and appears gray. Further, it is observed that the second compound layer 108*b* having a golden or yellowish silvery color is formed on the inner side the first compound layer 108*a*. It is possible to observe a purple region, which is the hue of purple gold, inside the second compound layer 108*b*, and it is understood that this region is a portion of the thin piece member 102.

The compound layer 108 which has a different hue clearly from those of the thin piece member 102 and the frame member 104 can be visually observed between the thin piece member 102 and the frame member 104. It can be visually recognizable that there are two regions of different hues in the compound layer 108. The boundary between the first compound layer 108*a* and the second compound layer 108*b* appears relatively clearly.

Hardness

The hardness of the jewelry item 100 was estimated by Vickers hardness. A microhardness tester (manufactured by Shimadzu Corporation: Model No. HMVG-FA-D) was used. The measurements of Vickers hardness are in accordance with JIS (Japanese Industrial Standards) Z 2244-1 (corresponding to International Standard: ISO 6507-1: 2018).

Figure 10A:
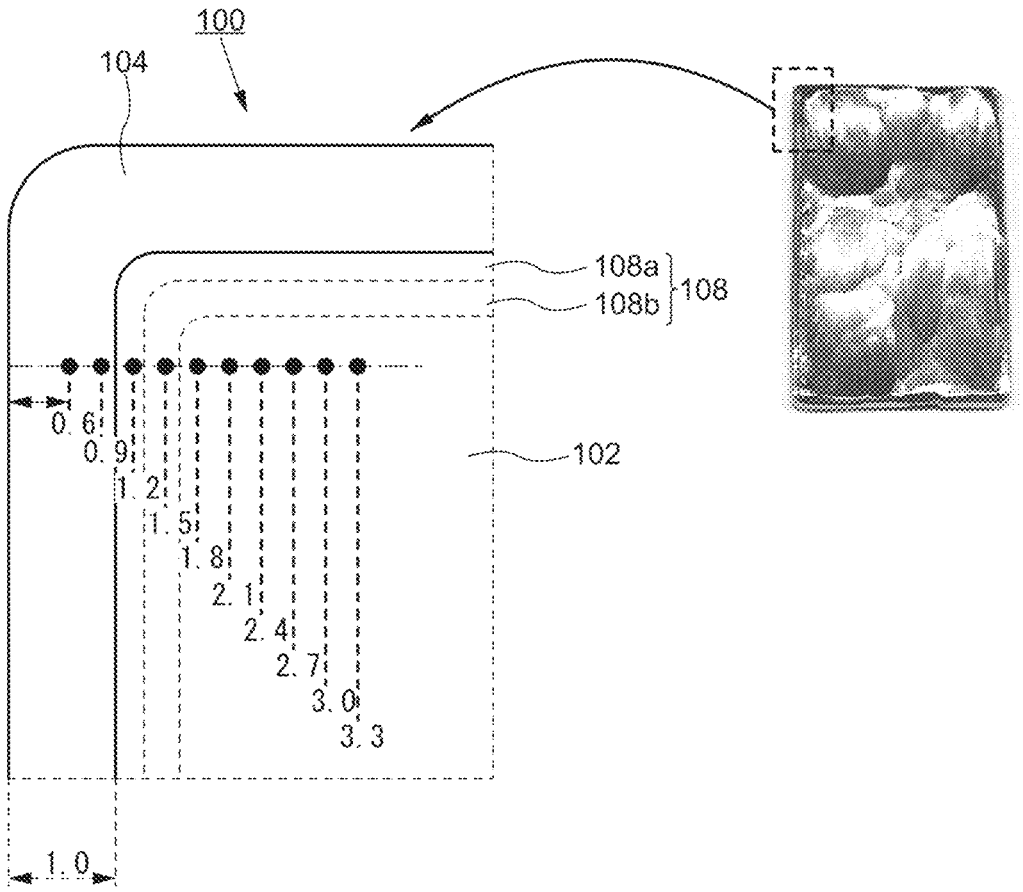
FIG. 10A is a diagram for explaining a position where the characteristics of a jewelry item according to an embodiment of the present invention are measured, and shows a measurement point of Vickers hardness.

FIG. 10A schematically shows a photograph of the jewelry item 100 used for the measurement and details of the measurement position. The Vickers hardness was measured at intervals of 0.3 mm from a point 0.6 mm inward from the end of the jewelry item 100 (the outer edge of the frame member 104). As shown schematically in FIG. 10A, the width of the frame member 104 is 1.0 mm, and therefore the measurement points at 0.6 mm and 0.9 mm from the edge correspond to the portion of the frame member 104 (made of platinum). It is understood that the measurement points 1.2 mm and 1.5 mm inside the frame member 104 are regions corresponding to the compound layer 108, and the measurement points 1.8 mm or more inside correspond to a region corresponding to the thin piece member 102 (made of purple gold).

Table 1 shows the results of Vickers hardness measurements. The measurement points 0.6 mm and 0.9 mm are Vickers hardness of the frame member 104, and 77.6 HV0.1 and 77.5 HV0.1 were measured, respectively. Generally, Vickers hardness of Pt 900 is 60 to 130 HV0.1. Therefore, it is considered that this measurement result reflects the hardness of Pt 900 used as the frame member 104.

TABLE 1

| Distance from Edge [mm] | Vickers hardness [HV0.1] |
|---|---|
| 0.6 | 77.6 |
| 0.9 | 75.5 |
| 1.2 | 598 |
| 1.5 | 455 |
| 1.8 | 270 |
| 2.1 | 270 |
| 2.4 | 262 |
| 2.7 | 272 |
| 3.0 | 291 |
| 3.3 | 276 |

The value of Vickers hardness at the measurement points of 1.2 mm and 1.5 mm corresponding to the region of the compound layer 108 just inside the frame member 104 were 598 HV0.1 and 455 HV0.1, respectively. This region showed a rapid increase in hardness relative to the frame member 104 formed from platinum. The measurement point 1.2 mm is a region corresponding to the first compound layer 108*a* having a gray hue in appearance, and the measurement point 1.5 mm is a region corresponding to the second compound layer 108*b* exhibiting a silver color tinged with gold or yellow in appearance. It is considered that the difference in Vickers hardness between the two regions is not a measurement error but a significant difference when comparing the two data. It is estimated that the first compound layer 108*a* and the second compound layer 108*b* have different compositions because the two measurement points have different Vickers hardness with respect to the hue.

The area inside the measurement point 1.8 mm is the thin piece member 102 and is the region in which the hue of purple gold appears. The value of Vickers hardness in this region is in the range of 270 HV0.1 to 291 HV0.1, and it is considered to be the original hardness of the purple gold.

The Table 1 show that the compound layer 108 formed between the frame member 104 made of platinum and the thin piece member 102 made of purple gold is a very hard region. It is considered that at least two regions having different compositions (the first compound layer 108*a* and the second compound layer 108*b*) exist in the compound layer 108 in consideration of the apparent difference in hue.

Composition

As described above, the jewelry item according to this embodiment includes the frame member 104, the thin piece member 102, and the compound layer 108 between the frame member 104 and the thin piece member 102. In this structure, the composition of each part was measured. The measurement was carried out using an X-ray fluorescence analyzer (JSX-1000S made by JEOL).

Figure 10B:
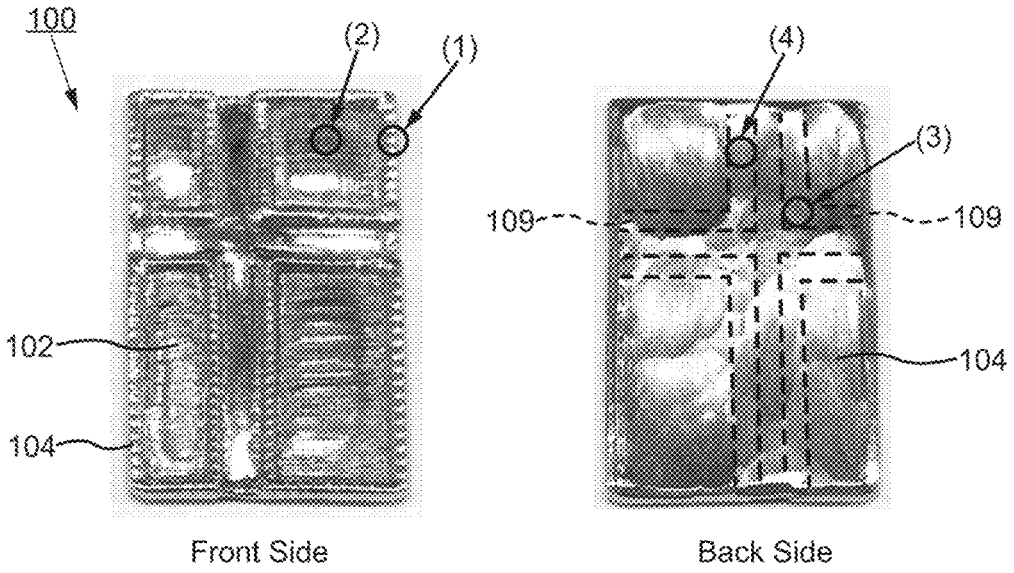
FIG. 10B is a diagram for explaining a position where the characteristics of a jewelry item according to an embodiment of the present invention are measured, and shows a measurement point of fluorescent X-ray analysis.

FIG. 10B shows a photograph of a front side and a back side of the sample used for an X-ray fluorescence analysis. The X-ray fluorescence analysis measured the following four portions: (1) a region (a front surface side) of the frame member 104; (2) a region (the front surface side) of the thin piece member 102; (3) a region (a back surface side) of the compound layer 108 that appears gold or yellowish silver; and (4) a region (the back surface side) of the compound layer 108 that appears grey.

Figure 11A:
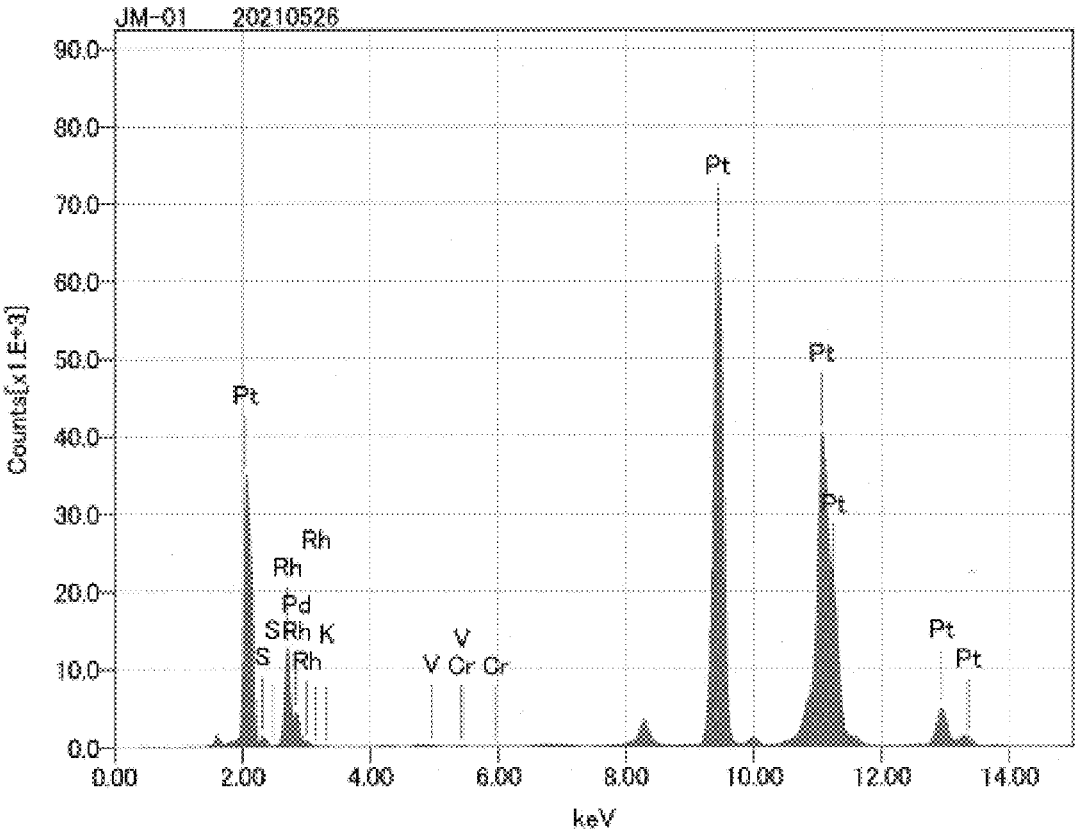
FIG. 11A shows a fluorescent X-ray spectrum of a jewelry item according to an embodiment of the present invention, and shows data at a measurement point (1)
Figure 11B:
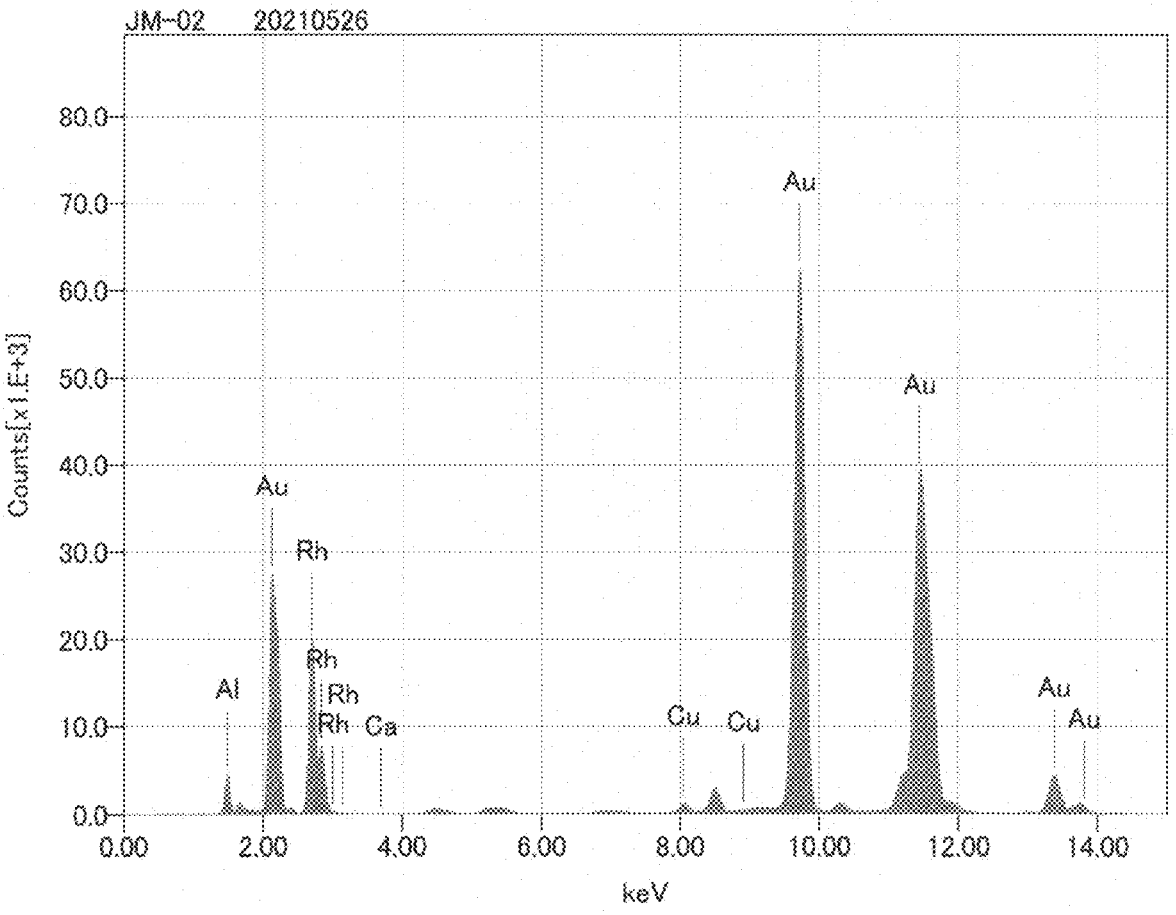
FIG. 11B shows a fluorescent X-ray spectrum of a jewelry item according to an embodiment of the present invention, and shows data at a measurement point (2)
Figure 12A:
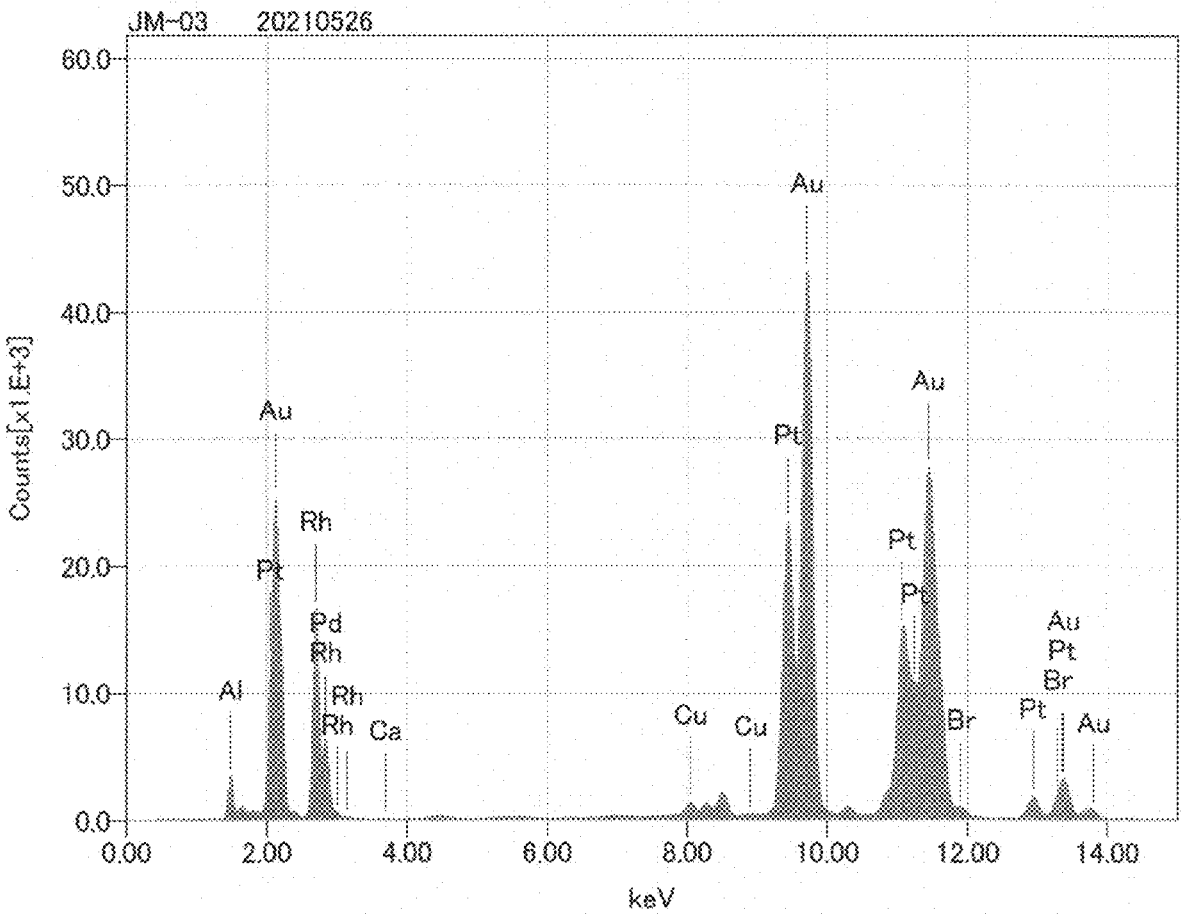
FIG. 12A shows a fluorescent X-ray spectrum of a jewelry item according to an embodiment of the present invention, and shows data at a measurement point (3)
Figure 12B:
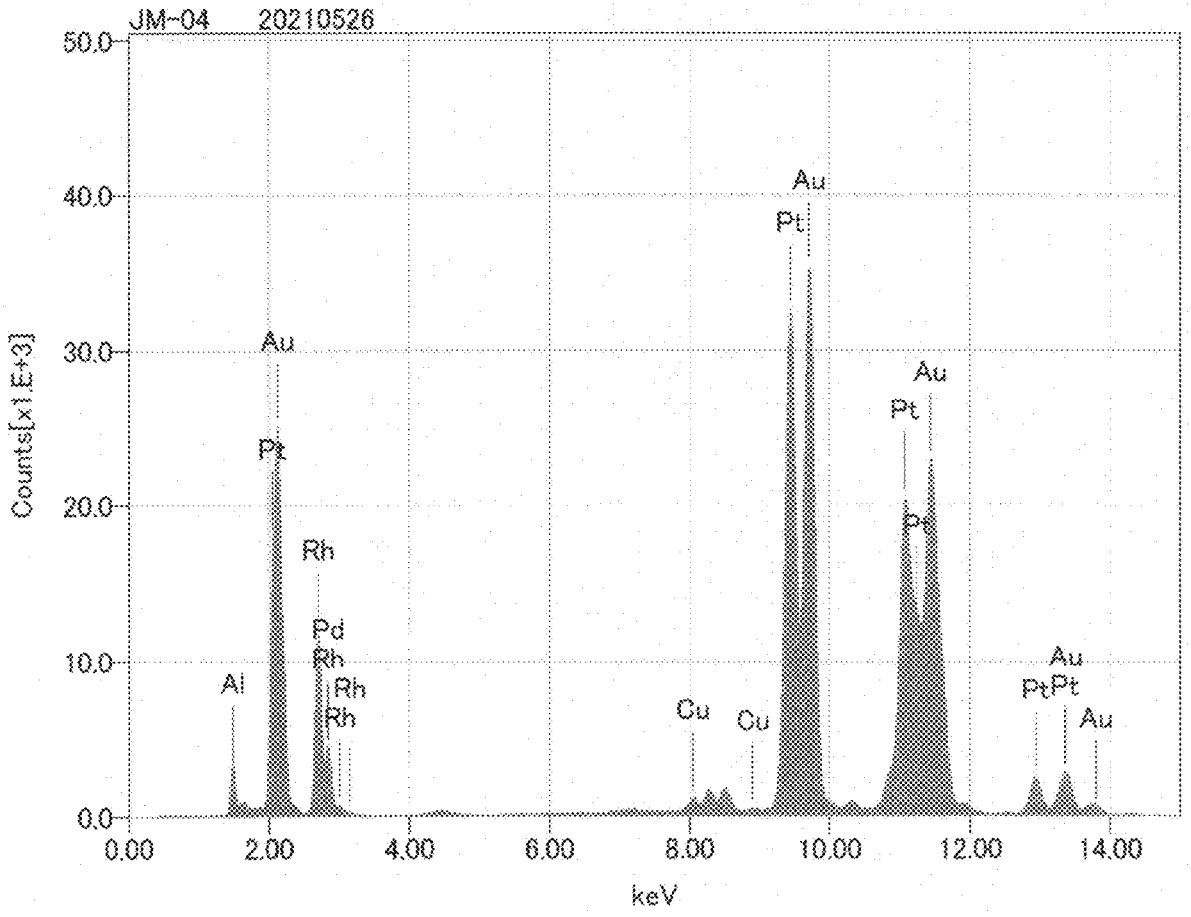
FIG. 12B shows a fluorescent X-ray spectrum of a jewelry item according to an embodiment of the present invention, and shows data at a measurement point (4).

FIG. 11A, FIG. 11B, FIG. 12A, and FIG. 12B show X-ray fluorescence spectra measured at each measurement point. FIG. 11A shows an X-ray fluorescence spectrum of the measurement point (1), in which peaks of platinum (Pt) and palladium (Pd) are observed. FIG. 11B is a fluorescent X-ray spectrum at the measurement point (2), and peaks of gold (Au) and aluminum (Al) are observed. FIG. 12A is a fluorescent X-ray spectrum at the measurement point (3), and spectra of gold (Au), platinum (Pt), palladium (Pd), and aluminum (Al) are observed. FIG. 12B shows a fluorescent X-ray spectrum at the measurement point (4), and spectra of gold (Au), platinum (Pt), palladium (Pd), and aluminum (Al) are confirmed, but the intensity ratio of gold (Au) to platinum (Pt) is different from that at the measurement point (3).

Table 2 shows the results of quantifying each element from the measurement of FIG. 11A, FIG. 11B, FIG. 12A, and FIG. 12B.

TABLE 2

| | Detected Element [wt. %] | | | |
|---|---|---|---|---|
| Point | Al | Pd | Pt | Au |
| (1) | — | 8.5400 | 90.2300 | — |
| (2) | 22.4100 | — | — | 77.0900 |
| (3) | 17.0100 | 2.2600 | 29.3200 | 50.9000 |
| (4) | 15.4000 | 4.3550 | 39.9200 | 40.1600 |

Platinum (Pt) and palladium (Pd) which are components of the frame member 104 are detected at the measurement point (1) as shown in Table 2. Since the frame member 104 is platinum 900, it is considered that the component ratio of platinum (Pt) and palladium (Pd) substantially corresponds to the component ratio of the material in the data at the measurement point (1). Gold (Au) and aluminum (Al) which are components of the purple gold forming the thin piece member 102 are detected at the measurement point (2). Measurement point (2) shows a result of 77.09 wt. % of gold (Au) and 17.01 wt. % of aluminum (Al). This result almost closely corresponds to the composition ratio of gold (Au) and aluminum (Al) that form purple gold.

The measurement points (3) and (4) are the results of a measurement of a portion corresponding to the compound layer 108, and both metal elements constituting the frame member 104 and metal elements constituting the thin piece member 102 are detected. That is, gold (Au), platinum (Pt), palladium (Pd), and aluminum (Al) are detected at the measurement points (3) and (4). Therefore, it is considered that an alloy of these metals is formed at the measurement points (3) and (4).

The content of gold (Au) is the highest at the measurement point (3), and the content of other metal elements is lower in the order of platinum (Pt), aluminum (Al), and palladium (Pd), as shown in Table 2. On the other hand, the ratio of gold (Au) and platinum (Pt) is almost the same at the measurement point (4), and the ratio of palladium (Pd) is higher, and the ratio of aluminum (Al) is lower than at the measurement point (3). It is understood from this result that the measurement point (4) contains more metal components constituting the frame member 104 than the measurement point (3).

The measurement point (4) is a portion with the silver-white hue on the back surface side of the sample and is the position overlapping the frame member 104. The measurement point (4) is considered to indicate the composition of the first compound layer 108*a* exhibiting a gray hue produced along the frame member 104, in relation to the regions of different apparent hues shown in FIG. 9B. The measurement point (3) is considered to indicate the composition of the second compound layer 108*b* exhibiting the gold or yellowish silver color.

As described above, the jewelry item 100 according to the present embodiment has a compound layer 108 having a composition different from that of the thin piece member 102 between the frame member 104 and the thin piece member 102. The compound layer 108 contains both metal elements constituting the frame member 104 and metal elements constituting the thin piece member 102, and it is considered that an intermetallic compound is formed. The compound layer 108 is harder than the frame member 104 and the thin piece member 102 and has a different hue in appearance. The compound layer 108 further includes at least two regions having different compositions. The first compound layer 108*a* formed on the side of the frame member 104 has a higher component ratio of metal elements constituting the frame member 104 than the second compound layer 108*b* formed on the side of the thin piece member 102, and has a relatively hard Vickers hardness.

According to the present embodiment, the compound layer 108, which is an intermetallic compound, is provided between the frame member 104 and the thin piece member 102, and the compound layer 108 has a characteristic that it is hard on the frame member 104 side and its hardness is slightly reduced on the thin piece member 102 side, thereby providing the rugged and durable jewelry item 100.

As described above, according to one embodiment of the present invention, the compound layer having a different hue can be formed between the frame member and the thin piece member by casting and cooling a gold alloy (purple gold) by the injection casting method in order to be bonded to the frame member 104 made of platinum. The compound layer is much harder in Vickers hardness than platinum and purple gold and can make jewelry item rugged. This configuration makes it possible to make jewelry item with a single unit size of 0.5 mm thick and an area of over 100 $mm^2$. Thus, the design and size of the jewelry item using purple gold can be varied, and the price competitiveness of the jewelry item using other materials can be improved.

The jewelry item according to one embodiment of the present invention does not require frame alignment and processing can be shortened by integrating a platinum frame member and a purple gold thin piece member. It is possible to provide light and comfortable jewelry item having various designs.

What is claimed is:

1. A jewelry item, comprising:

a thin piece member formed from gold (Au)-aluminum (Al) alloy, the thin piece member having a first cross-sectional thickness;

a frame member formed from platinum (Pt)-palladium (Pd) alloy and surrounding a peripheral edge of the thin piece member, the frame member having a second cross-sectional thickness; and a compound layer interposed between the thin piece member and the frame member, and comprising metal components of the thin piece member and the frame member, wherein:

the first cross-sectional thickness is less than or equal to the second cross-sectional thickness;

the compound layer includes a first compound layer formed along the frame member and a second compound layer formed along an inside of the first compound layer;

the first compound layer includes a first intermetallic compound comprising 50% by weight or more of gold (Au) and aluminum (Al) and less than 50% by weight of platinum (Pt) and palladium (Pd);

the second compound layer includes a second intermetallic compound comprising 60% by weight or more of gold (Au) and aluminum (Al) and less than 40% by weight of platinum (Pt) and palladium (Pd);

the thin piece member and the frame member are bonded by the first compound layer and the second compound layer;

the first compound layer has a first width in a direction extending from the frame member toward the thin piece member;

the second compound layer has a second width in the direction extending from the frame member toward the thin piece member;

the first compound layer has a first hue extending across the first width;

the second compound layer has a second hue extending across the second width; and the first hue and the second hue are different and distinguishable in appearance.

2. The jewelry item according to claim 1, wherein a hardness of the compound layer is harder than a hardness of the thin piece member and the frame member.

3. The jewelry item according to claim 1, wherein the first hue and the second hue are different from a hue of the thin piece member.

4. The jewelry item according to claim 1, wherein a width of the compound layer is 1 mm or less.

5. The jewelry item according to claim 1, wherein a hardness of the first compound layer is harder than a hardness of the second compound layer.

6. The jewelry item according to claim 1, wherein the thin piece member is formed by molten gold (Au)-aluminum (Al) alloy injected into a mold including the frame member at a pressure of 0.2 MPa or higher and thereafter quenched.

7. The jewelry item according to claim 1, wherein the first compound layer and the second compound layer are separated by a distinct boundary.

8. The jewelry item according to claim 1, wherein the thin piece member is formed by molten gold (Au)-aluminum (Al) alloy injected into a mold including the frame member at a pressure of 0.2 MPa or higher; and the first width and the second width are controlled by cooling the molten gold (Au)-aluminum (Al) alloy to obtain the first compound layer having the first intermetallic compound and the second compound layer having the second intermetallic compound.

9. The jewelry item according to claim 1, wherein the frame member has a first hardness along the direction extending from the frame member toward the thin piece member at a first point within the frame member farther from the first compound layer than a second point within the frame member between the first point and the first compound layer;

the frame member has a second hardness at the second point less than the first hardness, the first compound layer has a third hardness along the direction extending from the frame member toward the thin piece member at a third point within the first width of the first compound layer, the third hardness being greater than the first hardness;

the second compound layer has a fourth hardness along the direction extending from the frame member toward the thin piece member at a fourth point within the second width of the second compound layer, the fourth hardness being greater than the first hardness and less than the third hardness; and the thin piece member has a fifth hardness at a fifth point along the direction extending from the frame member toward the thin piece member, the fifth hardness being less than the fourth hardness and greater than the first hardness.

10. The jewelry item according to claim 9, wherein the thin piece member is formed by molten gold (Au)-aluminum (Al) alloy injected into a mold including the frame member at a pressure of 0.2 MPa or higher, and the first width and the second width are controlled by cooling the molten gold (Au)-aluminum (Al) alloy to obtain the first compound layer having the first contents and the second compound layer having the second contents, resulting in a hardness profile comprising the first hardness, the second hardness, the third hardness, the fourth hardness and the fifth hardness.

* * * * *